United States Patent [19]

Djordjevic et al.

[11] 4,286,558

[45] Sep. 1, 1981

[54] CENTRIFUGAL RPM GOVERNOR FOR FUEL INJECTED INTERNAL COMBUSTION ENGINES, ESPECIALLY AN IDLING AND FINAL RPM GOVERNOR FOR DIESEL VEHICLE ENGINES

[75] Inventors: Ilija Djordjevic; Ernst Ritter, both of Stuttgart; Thomas Lang, Schwäbisch Hall, all of Fed. Rep. of Germany

[73] Assignee: Robert Bosch GmbH, Stuttgart, Fed. Rep. of Germany

[21] Appl. No.: 50,584

[22] Filed: Jun. 21, 1979

[30] Foreign Application Priority Data

Jan. 4, 1979 [DE] Fed. Rep. of Germany ..... 2900198

[51] Int. Cl.[3] ..... F02D 1/04

[52] U.S. Cl. ..... 123/368; 123/373; 123/374; 123/371

[58] Field of Search ..... 123/140 J, 140 R, 139 ST, 123/179 L, 179 G, 368, 373, 374, 371

[56] References Cited

U.S. PATENT DOCUMENTS

| | | | |
|---|---|---|---|
| 3,530,845 | 9/1970 | Staudt | 123/140 R |
| 3,577,968 | 5/1971 | Staudt | 123/140 R |
| 3,659,570 | 5/1972 | Yoshino | 123/140 R |
| 3,759,236 | 9/1973 | Staudt | 123/140 R |
| 3,923,026 | 12/1975 | Aoki | 123/140 R |
| 4,038,958 | 8/1977 | Susuki | 123/140 R |
| 4,143,634 | 3/1979 | Ritter | 123/139 ST |
| 4,148,290 | 4/1979 | Knorreck | 123/140 R |

FOREIGN PATENT DOCUMENTS

| | | | |
|---|---|---|---|
| 2802934 | 7/1978 | Fed. Rep. of Germany | 123/140 R |
| 2731968 | 1/1979 | Fed. Rep. of Germany | 123/140 R |

*Primary Examiner*—Charles J. Myhre
*Assistant Examiner*—Carl Stuart Miller
*Attorney, Agent, or Firm*—Edwin E. Greigg

[57] ABSTRACT

A centrifugal governor for fuel injected internal combustion engines is proposed, especially an idling and final rpm governor for Diesel vehicle engines, in which the sudden emission of smoke upon starting of a heavily loaded engine is prevented. The improved governor comprises an additional idling spring secured on a force transmitting lever which is acted upon by the main control spring and by means of which additional idling spring in the idling setting of the service lever the restoring force of the idling spring on a portion (b) of the idling sleeve path (a) is amplified. This force of the additional idling spring is, however, made at least partially ineffective by a thrust member when the service lever is pivoted into the full-load position. Further, there is disclosed a governor which is equipped with an additional idling spring which comprises two additional springs, the aforementioned thrust member being arranged to act only upon the second additional spring, while the first additional spring remains coupled with the governor sleeve via a connecting member in order to improve starting.

11 Claims, 5 Drawing Figures

CENTRIFUGAL RPM GOVERNOR FOR FUEL INJECTED INTERNAL COMBUSTION ENGINES, ESPECIALLY AN IDLING AND FINAL RPM GOVERNOR FOR DIESEL VEHICLE ENGINES

BACKGROUND OF THE INVENTION

The invention is related to a centrifugal rpm governor for fuel injected internal combustion engines, especially an idling and final rpm governor for Diesel vehicle engines and revealed herein and finally claimed. A centrifugal rpm governor of this design is already known (German Auslegeschrift 22 24 755), in whch the idling spring embodied as a leaf spring is secured on a force transmitting lever which is acted upon by the main control spring and the restoring force of this idling spring is reinforced over a portion of the idling sleeve path by an additional idling spring acting at least indirectly on the control member and also supported on the force transmitting lever. This control spring combination serves to stabilize the idling of the engine, whereby the idling spring is so designed that a sufficiently large load acceptance is possible. Further, the additional idling spring acts in a known manner by partially increasing the P-factor of the "sudden zero-gas stabilization means", by means of which the engine does not stall even on a sudden decrease in load. As a result of the disposition of both springs which affect idling on the force transmitting lever, the exertion of their force is automatically excluded after the idling sleeve path has been covered, so that in an advantageous manner these springs do not affect the characteristic curve for deregulation. When the engine is starting with the service lever in the full-load position, the increased P-factor and the force of the springs which are effective during idling control are also exerted on the deregulation of the increased starting quantity in a disadvantageous way, and the deregulation point of the increased starting quantity moves in the direction of higher rpm. As a result there is a danger that when the engine is heavily loaded and the engine speed is therefore dropping, the maximal fuel quantity defined by the full-load stop is suddenly increased, at appropriately low engine speed, in the direction of the increased starting quantity. As a result, there is a puff of exhaust smoke, and the emission values are impermissibly increased.

From German Patent No. 838,380, an idling and final rpm governor is known whose main control spring is disposed in the flyweights and whose idling spring is disposed in a spring capsule on the governor housing. In this governor, the idling spring is made ineffective when the service lever is at full-load, so that it does not affect the P-factor during deregulation, while a high P-factor is still attained in the idling position of the service lever. This design of an idling and final rpm governor, which diverges from the generic centrifugal rpm governor, does not enable an increased starting quantity which is automatically set in the full-load position of the service lever and controlled by the idling spring, and the effect of the idling spring is not supplemented by an additional idling spring, which has the disadvantage that when the P-factor of the idling spring is sufficiently high there is good sudden zero-gas stabilization but a very poor load acceptance, or when the P-factor of the idling spring is low, there is a good load acceptance but a poor sudden zero-gas stabilization.

In centrifugal rpm governors having—in contrast to the known governors described above—a main control spring pivotable by means of the service lever in order to set the desired rpm and also acting as the idling control spring, it is now known (German Patent No. 2,048,635) to make an additional idling spring supported in the govenor housing at least partially ineffective in accordance with the position of the service lever. In this governor, it is intended thus to preclude any influence by the additional idling control spring on the P-factor of the main control spring during the regulation of the final rpm, because there, especially when used in supercharged Diesel engines, the additional idling control spring leads to an impermissible elevation of the upper zero-load rpm limit. However, this spring exerts no influence on the control of the increased starting quantity.

OBJECT AND SUMMARY OF THE INVENTION

The centrifugal rpm governor as disclosed herein has the advantage over the prior art that as a result of making the additional idling spring at least partially ineffective on starting the engine and during full-load operation a delay in the withdrawal of the increased starting quantity is avoided and that in full-load operation of the engine when the rpm is lowered by a heavy load, there is not any undesired increase in quantity. By making the additional idling spring ineffective, the starting quantity coasting rpm, that is, the rpm at which the increased starting quantity is no longer effective, is shifted into a range below the lowest operational rpm. Thus, without additional auxiliary mechanical means, an automatic suppression of the starting quantity is attained.

By means of the characteristics of the dependent claims, advantageous improvements and further embodiments of the centrifugal rpm governor of the main claim are possible. Thus, by means of the characteristics of claims 2 and 3, it is attained that the additional idling spring, independently of the disposition and mode of operation of the idling spring, acts upon the control member either directly at the control member or via a guide lever known from German Patent No. 1,080,514 (FIGS. 3 and 4) which is supported on the rotary axis of the force transmitting lever and guides one end of the control member.

If the centrifugal rpm governor known from the document cited at the outset is equipped with an additional idling spring embodied as a leaf spring and having one end thereof secured to the force transmitting lever, with the effective range of this additional idling spring determinable by means of an adjustable stop member, then through the characteristics of claim 4, the setting of the part of the idling sleeve path which determines the effective range of the additional idling spring can be undertaken at the adjusting nut, which can be so disposed that it is easily accessible when the governor cover is taken off and without influencing other setting values even when the governor is running. Because of the connecting bolt secured on the end of the additional idling spring, no guide is required for the connecting bolt, and thus no friction of any kind occurs at this point because of the omission here of one articulation point, which improves the function and control accuracy of the governor in an advantageous manner.

By means of the characteristics of claim 5, the alternative possible usage of a compression spring as the additional idling spring is shown, because the concept of the invention is not limited to the usage of leaf springs.

If the associated Diesel engine is operated at great altitudes and the full-load injection quantity is accordingly reduced because of the reduced air charge, then starting up with a manual transmission becomes problematical, because as a result of the ineffective additional idling spring, the injection quantity in the low rpm range is retracted so early that starting up is made more difficult. This disadvantage appears particularly when the engine is equipped with an automatic transmission and requires a higher starting output. For this reason, by means of the characteristics of claims 7–11, the effect of the additional idling spring is divided into two additional springs in a particularly advantageous manner, only one of which springs is directly acted upon by the thrust member. By appropriate mutual adaptation of the spring stiffnesses and the points of first effectiveness of the idling spring and of the two additional springs, the governor can be very intentionally adjusted and designed with respect both to starting behavior and to engine requirements. Thus, by means of the drag member in accordance with claims 10 and 11, the first additional spring can be prestressed, when the service lever is pivoted into the full-load position and the second additional spring is ineffective, to such an extent that sufficient quantity is available during starting, but an excessive amount of smoke cannot form when the rpm level is dropping because of the heavy load. By means of the step in the curve of starting quantity deregulation thus attainable, additional means for a reduction in starting quantity can be omitted in certain cases.

If in accordance with claim 12 the thrust member is embodied by a thrust screw which is adjustable at the setting member with a radial distance from the axis of the lever shaft and secured positionally, then the deregulation path of the additional idling spring can be set without steps, independently of other setting points.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
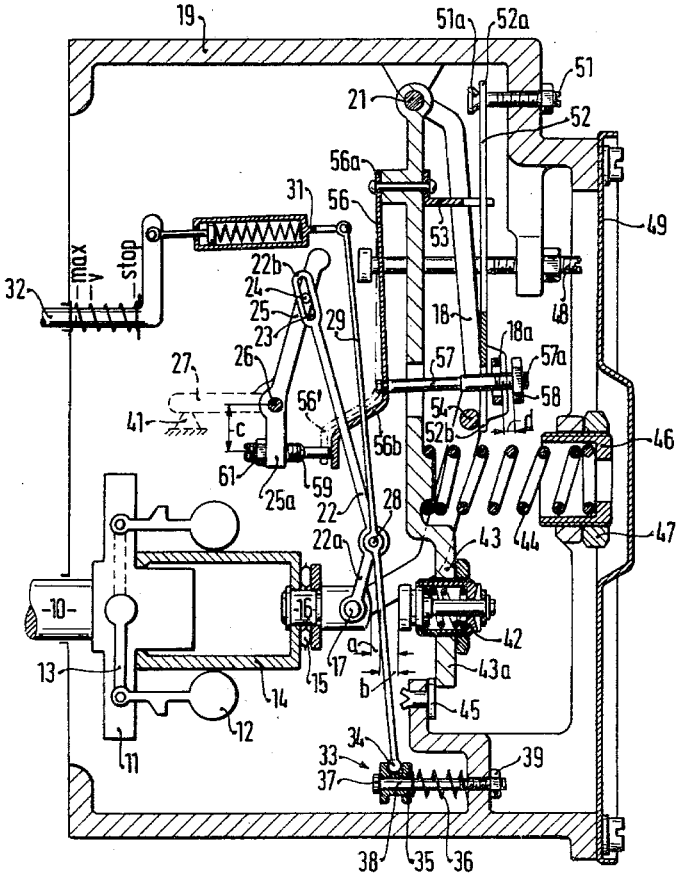
FIG. 1 is a simplified cross-sectional view through the first exemplary embodiment.

In the first exemplary embodiment shown in simplified form in FIG. 1, there is secured on the camshaft 10 of a known injection pump for internal combustion engines, which is not shown in further detail, a flyweight carrier 11 of a centrifugal rpm governor embodied as an idling and final rpm governor, on which carrier 11 flyweights 12 are supported in a pivotable manner. These flyweights 12, with pressure arms 13, engage a governor sleeve 14 which serves as the control member and is thus adapted to transmit the sleeve stroke effected by the flyweights 12 to a bolt 16 secured to the sleeve via a pressure bearing 15. The bolt 16 is articulated by means of a bearing tang 17 that is disposed on a guide lever 18 and which is pivotable on a bearing pin 21 secured in the governor housing 19 and thus guides the governor sleeve 14 in its stroke movements.

By means of the bearing tang 17, an end **22*a* of a shift lever 22 is also articulatedly connected with the sleeve bolt 16 of the governor sleeve 14, and another end 22*b* of this shift lever 22 is pivotably connected, by means of a slotted guide 23, with a pin 24 of a lever-like setting member 25. The setting member 25 is oscillatably secured on a lever shaft 26 supported as a pivot axis in the governor housing 19 and in turn also serves to support a service lever 27 shown in broken lines that is located outside the governor housing. The shift lever 22 is connected via a bearing point 28 located between its two ends 22*a* and 22*b* with an intermediate lever 29 which serves as a control lever. The control lever is articulated at one end via an elastically yielding tongue 31 onto a control rod 32 which serves as the supply quantity adjustment member of the injection pump and is pivotably supported on the other end on a slidable bearing member 33. This bearing member 33 comprises a sliding contact 35 which includes upstanding spaced shoulders between which is provided an annular groove that receives the bearing element 34 of the intermediate lever 29. The sliding contact 35 in its position of rest, as shown, is pressed by a deflection spring 36 against a head 37 of a setting screw 38 which functions as a stop. It will be understood that the screw 38 is adjustably secured in the governor housing 19. By adjustment of the setting screw 38, which is secured to the housing 19 by a nut 39, the bearing point 34 of the intermediate lever 29 is fixed in the axial direction of the governor sleeve 14 and can be changed by means of twisting the setting screw 38 for the purpose of making the basic setting of the full-load position of the control rod 32 which determines the full-load supply quantity, when, as is often desired by the engine manufacturer, the illustrated starting position and full-load position of the service lever 27 and thus of the setting member 25 is fixed by means of a full-load stop 41** that is attached to the housing and is not variable.

The basic setting mentioned above may be undertaken when in the illustrated start and full-load position of the setting member 25 the engine is running at an rpm which ranges between the idling rpm and the final rpm, the governor sleeve 14 has covered an idling sleeve path distance designated by the letter "a", and the pressure bolt 16 then contacts an adapter capsule 42 which here serves as the stroke stop. The adapter capsule 42 is screwed into a force transmitting lever 43, which is pivotable about the bearing pin 21 and with its lower free end **43*a* is pressed by a main control spring 44 against a stop 45 that is attached to the housing. The initial stressing force of the main control spring 44 which functions as the final rpm control spring is determined by the position in which it is installed and can be readily set by means of a support 46 which comprises a threaded plug that is screwed into the governor housing 19. The threaded plug 46 is secured by means of a lock nut 47 in its set position and is disposed, like the stroke stop 42 and the setting screw 38 of the pivotal bearing 33 as well as an idling stop 48 embodied as a stop screw, within the governor housing 19 and is, like them, only accessible when a locking cover 49 is removed. This locking cover 49** that is sealed on the engine prevents the unauthorized adjustment of the above-noted stops and thus fulfills the requirements of vehicle manufacturers that the adjustment points on the governor which influence the exhaust gas values must be inaccessible, or be accessible only with extreme difficulty.

Only the setting screw 51 which is adapted for the correction of the idling rpm of the engine is located outside the housing portion closed off by the cover 49 and thus is also accessible in the case of the sealed governor when the cover is removed. This is particularly advantageous, and is necessary for the purpose of adapting the idling rpm to the varying internal friction of different engines. A head 51*a* of the setting screw 51 located inside the governor housing 19 acts as an adjustable support for an end 52*a* of an idling spring member 52 embodied as a leaf spring, which is supported on the force transmitting lever 43 via a support angle bracket 53 which serves as a fixed support bearing or seat and with its terminal end 52*b* remote from the support 51*a* presses against a transverse bolt 54 that is disposed on the guide lever 18.

On the force transmitting lever 43, at the level of the fastening of the support angle bracket 53, there is also secured one end 56*a* of an additional idling spring member 56 which is embodied as a leaf spring, the other end area 56*b* of which is provided with a connecting bolt 57 which serves as a connecting member. The connecting bolt 57 that is secured to the additional idling spring 56 is arranged to project through a recess in the force transmitting lever 43 as well as another recess provided in the idling spring 52. The connecting bolt 57 further includes a threaded end 57*a* which is provided with an adjusting nut 58 which serves as a stop member, the distance d of which from a coupler part 18*a* determines the portion b of the idling sleeve path a which determines the effective range of the additional idling spring member 56. In this effective range b of the additional idling spring member 56, the adjusting nut 58 is supported on the coupler part 18*a* which is rigidly connected to the guide lever 18.

A screw member 59 which serves as a thrust member also engages the end 56*b* of the additional idling spring member 56 and is screwed into one lever arm 25*a* of the setting member 25 and secured in its inserted position by a locking nut 61. In the illustrated full-load position of the service lever 27 and thus also of the setting member 25, the thrust screw 59 had displaced the additional idling spring means 56 out of its position of rest, indicated with broken lines by the reference numeral 56', into the illustrated position, in which the adjusting nut 58 is at a distance from the coupler part 18*a* of the guide lever 18 such that the guide lever 18, within the idling sleeve path a, does not contact the adjusting nut 58, so that in accordance with the invention the exertion of force of the additional idling spring member 56, in the full-load position assumed by the service lever 27 during starting as well, is entirely precluded. By appropriate correction of the setting of the thrust screw 59 if desired, the additional idling spring member 56 can also be pushed only so far back that it is effective over only a portion of the efffective range b. As a result of the radial distance c of the thrust screw 59 from the axis of the lever shaft 26, the thrust movement occurring at the corresponding pivot angle of the service lever 27 and the associated pattern by which the spring 56 is displaced by the screw 59 are determined. If, in place of the thrust screw 59, a cam acting as the thrust member is provided, then the above displacement pattern can also be accordingly varied, which may be of advantage in particular kinds of usage.

In the arrangement according to the invention shown in FIG. 1, both the size of the thrust path and the effective range b of the additional idling spring member 56 can be set separately and independently from each other as a result of the separate adjustment capacity for the thrust screw 59 and the adjusting nut 58. As a result of the parallel position as shown of the connecting bolt 57 with respect to the idling stop 48 and as a result of the capacity for setting the adjusting nut 58 from outside after removal of the cover 49, all the setting points on the governor except for the thrust screw 59 can be adjusted from the outside and, as needed, by means of an automatic setting device as well, by which means economical testing and setting of the governor are possible.

Figure 3:
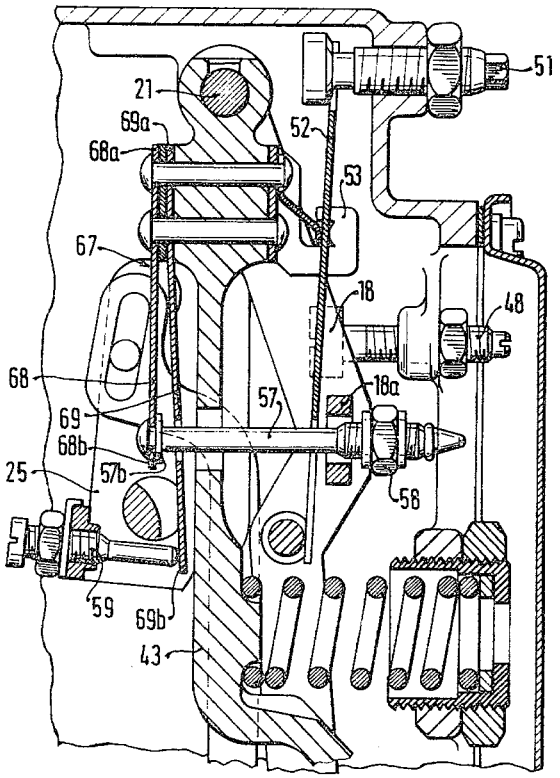
FIG. 3 is a further fragmentary sectional view according to FIG. 2 showing the third embodiment of the invention.
Figure 4:
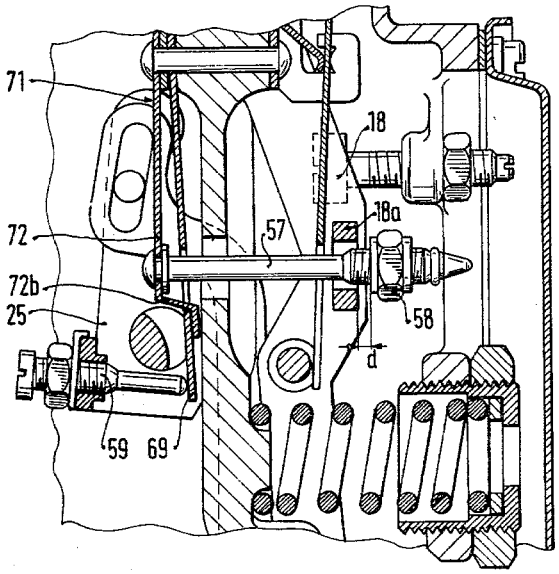
FIG. 4 is a fragmentary sectional view according to FIG. 2 showing the fourth embodiment of the invention.

The bent end 56*b* of the additional idling spring 56 of FIG. 1 is required only because the lever shaft 26 is displaced toward the left of the governor housing, as viewed in the drawing, and in practice may be embodied as a straight element, as shown in FIGS. 3 and 4, if the lever shaft 26 is brought correspondingly close to the force transmitting lever 43.

Figure 2:
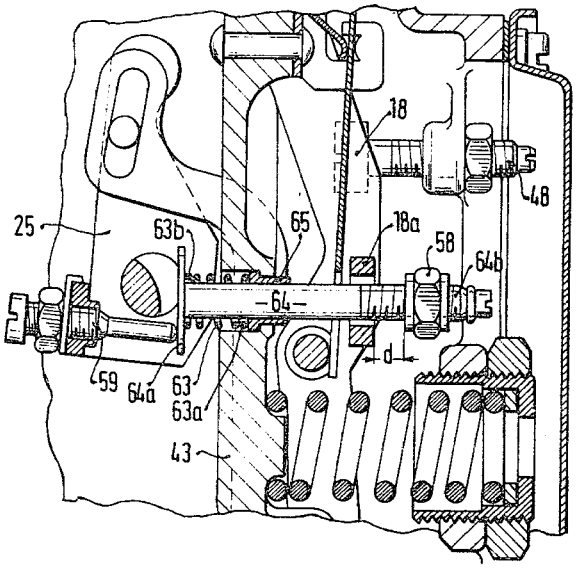
FIG. 2 is a fragmentary sectional view through the second exemplary embodiment showing only the characteristics essential to the invention.

FIG. 2 shows the portion essential to the invention of a second practically embodied example, in which the additional idling spring is embodied as a compression spring 63, which is inserted between the force transmitting lever 43 and a head 64*a* of a connecting member which is constructed to have an elongated shank 64. This member is supported in a guide bushing 65 in the force transmitting lever 43 adjacent to one end 63*a*, as shown, and with its terminal end 63*b* abutting on the head 64*a*. The elongated shank 64, which is guided displaceably in the guide bushing 65, has the adjusting nut 58 arranged as an elastic stop nut on its threaded end portion 64*b* that is remote from the head 64*a*. The distance d of the adjusting nut 58 from the coupler part 18*a* of the guide lever 18, as described in connection with FIG. 1, determines the effective range b of the additional idling screw 63, which in the illustrated full-load position of the setting member 25 is prestressed via the thrust screw 59 and the correspondingly displaced elongated shank 64 to such an extent that the coupler part 18*a* of the guide lever 18, during the idling sleeve path a of the governor sleeve 14, does not contact the adjusting nut 58 and thus is also not effective in the full-load position of the service lever 27. If the setting member 25 is brought into its idling position determined by the idling stop 48, then the thrust screw 59 is pivoted clockwise to such an extent that the coupler part 18*a* of the guide lever 18, within the portion designated b in FIG. 1 of the idling sleeve path a, contacts the adjusting nut 58. Thus, the additional idling spring 63, in order to stabilize idling, increases the P-factor effective in the idling control, as will be further explained below in connection with FIG. 5.

FIG. 3 shows the portion essential to the invention of the practically embodied third exemplary embodiment, in which the elements that are similar to those in FIG. 1. and having the same function are also given the same reference numerals. On the force transmitting lever 43, at the level of the securing of the support angle bracket 53 for the idling spring 52, there is also secured an additional idling spring 67, which in the present case comprises two additional spring element 68 and 69 which are embodied as leaf springs. The ends of these two additional springs 68 and 69, designated 68*a* and 69*a*, respectively, are riveted, together with the support angle bracket 53, to the force transmitting lever 43, while the other end 68*b* of the first leaf spring 68, like the additional idling spring 56 in FIG. 1, has the connecting bolt 57 provided with the adjusting nut 58 and the other end 69*b* on the second leaf spring 69 is acted upon by the thrust screw 59. In this arrangement, the spring stiffness of the additional idling spring 67 is divided between the two leaf springs 68 and 69 and because of the thrust screw 59 which is secured on the setting member 24, only the second leaf spring is made ineffective in the illustrated full-load position of the setting member 25, while the unchanged first leaf spring 68, via the adjusting nut 58 which serves as a stop member and the coupler part 18*a* on the guide lever 18 is effective in the effective range b of the additional idling spring (see FIG. 1 in this connection) even when the second leaf spring 69 is made ineffective. By this means, an improved starting behavior for the internal combustion engine is attained and despite this, the emission of smoke normally resulting during the starting operation is avoided by reason of the ineffective second leaf spring 69. In the idling setting of the setting member 25, which is not shown, and thus in that position of the service lever 27, which is not shown in further detail, the setting member 25 is in contact with the idling stop 48, and the thrust screw 59 is pivoted clockwise to such an extent that it no longer acts upon the end 69*b* of the second leaf spring 69. This leaf spring 69 then contacts a collar 57*b* carried by the connecting bolt 57, and in the idling position of the service lever 27, both leaf springs 68 and 69 thus act, as additional idling spring 67, and thus functions as a single spring.

In the fourth exemplary embodiment in accordance with FIG. 4, the additional idling spring, here designated 71, comprises two leaf springs 72 and 69, and are generally similar to the third exemplary embodiment disclosed in FIG. 3. The leaf spring 72 which functions as the first additional spring, like the first leaf spring 68 in FIG. 3, is securely assembled as shown to the connecting bolt 57. The leaf spring 72 is bent at an angle to its length and terminates in a tongue portion that extends in a parallel plane to the length of the main lever. The bent free end 72*b* is adapted to extend through an aperture in the leaf spring 69 and is thus arranged to act as a drag member on the second leaf spring 69. Except for the cooperation of the tongue on the leaf spring 72 with the leaf spring 69 the spring arrangement is practically identical to that shown in FIG. 3.

The first leaf spring 72 is more or less greatly prestressed, depending on the position and embodiment of the drag member 72*b*, by the second leaf spring 69 being thrust toward the right as viewed in the drawings by the thrust screw 59. As a result, as is described in more detail below in connection with FIG. 5, there is a step in the deregulation curve of the first leaf spring 72 with the service lever 27 or setting member 25 in the start or full-load position. Thus, the starting behavior of the vehicle, particularly when driving at high altitudes, is improved, without causing an impermissible emission of smoke, and no additional control devices are necessary for reducing the starting fuel quantity in accordance with temperature.

Figure 5:
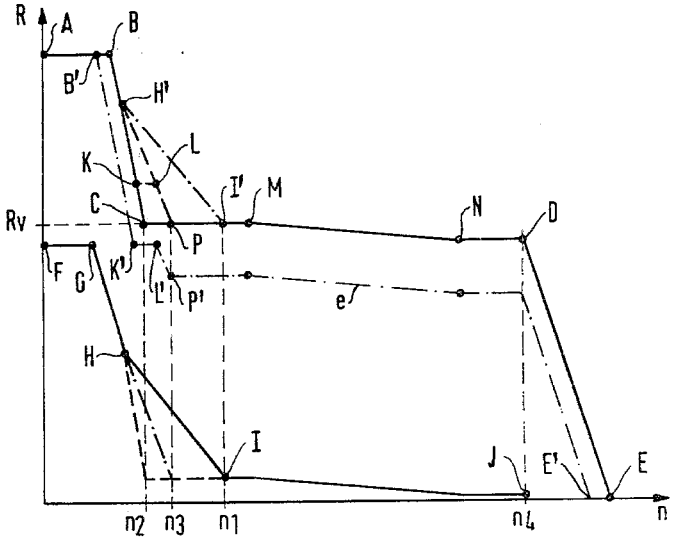
FIG. 5 is a diagram with control curves of the governor in accordance with the invention.

In the diagram of FIG. 5, some control curves are shown for the governor in accordance with the invention. In the ordinate, the path R of the control rod 32 is entered and in the abscissa the rpm n is entered. A curve A-B-C-D-E drawn in heavy lines represents the full-load control curve for the first and second exemplary embodiment and the curve F-G-H-I-J represents the corresponding idling control curve, with the curve portion H-J having an increased P-factor coming about as a result of the influence of the additional idling spring 56 or 63. In the full-load setting of the service lever 27, the influence of this additional idling spring 56 or 63 would cause a displacement of the deregulation of the increased starting fuel quantity to an rpm $n_1$ which corresponds to the curve section H'-I' marked with dot-dash lines. Because the additional idling spring 56, 63 is made ineffective during the full-load position of the service lever 27, the deregulation of the increased starting fuel quantity identified by the curve section A-B is controlled in accordance with the P-factor of the idling spring 52 along the curve section B-C. The increased starting fuel quantity is thus already ineffective at rpm $n_2$.

If the additional idling spring 67, 71 comprises, as in FIGS. 3 and 4, two additional springs 68 and 69 or 72 and 69, respectively, then, in order to attain an improved starting behavior, the deregulation point C for the increased starting quantity can be shifted toward P, which is accomplished by means of making the additional idling spring partially ineffective and will be described in further detail below when the function is described.

In the third exemplary embodiment in accordance with FIG. 3, the deregulation curve of the increased starting quantity then runs along the points B-H'-P and the increased starting quantity is thus first retracted at rpm $n_3$ all the way back to the full-load setting of the control rod 32 indicated by $R_V$. The stiffness of both additional springs may be selected to be such that $n_3$, in the loaded engine running at full-load, is not yet attained, while during starting up, a sufficient increase in fuel quantity is controllable without generating the emission of smoke.

As a result of the partially prestressed leaf spring 72 in the fourth exemplary embodiment according to FIG. 4, a step K-L-P shown in broken lines is created by means of which the necessary increase in fuel supply quantity during starting up can be directed without causing an emission of smoke. The curve e shown in dot-dash lines between B' and E' indicates a full-load curve which has been reduced for operation at altitude, where the step K'-L'-P' makes starting up at high altitudes easier.

The adaptation of the fuel supply quantity indicated by the curve section M-N is controlled by means of the adaptation capsule 42 (see FIG. 1) which functions as a stroke stop for the governor sleeve 14. However, this is not the subject of the present invention.

The mode of operation will now be described for the governors of FIGS. 1–4 in accordance with the invention, with the aid of various operational states, and the corresponding operational points of the curves are indicated in accordance with FIG. 5.

The rpm governor equipped with a single-part additional idling spring 56 or 63 in accordance with FIGS. 1 and 2 function identically and their mode of operation will therefore be discussed with the aid only of FIGS. 1 and 5. In the illustrated position of the setting member 25 and service lever 27, that is, at the maximal service lever position at engine shutoff and in the very low rpm range which occurs during starting of the internal combustion engine, the flyweights 12 assume the position illustrated. At this time, the governor sleeve 14, under the effect of the idling spring 52 which also functions as a starting spring, holds the guide lever 18 and by means of the guide lever 18 via the shift lever 22 and the intermediate lever 29 holds the control rod 32 in a starting position identified by A-B. In this position the fuel injection pump of the internal combustion engine supplies a quantity of fuel which exceeds the fullload fuel quantity and makes the startup of the engine easier. However, as soon as the cylinders of the engine have turned over, the centrifugal force of the weights 12 overcomes the force of the spring 52 and moves the governor sleeve 14 to the extent of the idling sleeve path a, until the bolt 16 contacts the stroke stop 42 of the force transmitting lever 43. In this position of the governor sleeve 14, the internal combustion engine is supplied with the full-load fuel quantity in the full-load position $R_V$ of the control rod 32.

Between points C and D, only an adaptation between M and N takes place under the control of the adaptation capsule 42, and only when the final rpm $n_4$ is exceeded at point D does deregulation take place at E.

If the service lever 27 and thus the setting member 25 are retracted into the idling position determined by the idling stop 48, the idling control runs, in all embodiments according to FIGS. 1–4, in accordance with the curve F-G-H-I-J. The flat curve path between I and J is controlled by the P-factor of the additional idling spring or springs and enables a very good stabilization of idling and causes a satisfactory zero-gas mode; that is, when the service lever 27 is rapidly retracted into the idling position, the engine is prevented from stalling. The steep curve section G-H, which is controlled solely by stiffness of the idling spring 52, represents the possibility of a very good load acceptance when the service lever 27 is in the idling position. If, in the full-load position of the service lever 27, the additional idling spring 56 were not made ineffective, then the deregulation of the increased fuel starting quantity would run according to B-H'-I and would first be terminated at $n_1$. That would cause an impermissible sudden emission of smoke already upon starting up, and also with the engine heavily loaded and the rpm dropping below $n_1$ would cause an increased emission of exhaust gas.

Because in the third exemplary embodiment in accordance with FIG. 3 only the second additional spring 69 is made ineffective in the full-load position of the setting member 25, the first additional spring 68 also affects the deregulation of the increased fuel starting quantity and the starting quantity curve runs between points A-B-H'P, as a result of which, as was already noted in connection with FIG. 5, improved starting is attained.

The same improved starting is also attained in the fourth embodiment according to FIG. 4, in which as a result of the partially prestressed first additional spring 72 the starting quantity curve is identified by the points A, B, K, L and P or by the points A, B', K', L' and P', as the case may be. The height of the step K-L-P or K'-L'-P' is determined by the prestressing path or the sleeve path to be covered, which is adjustable by means of the distance d between coupler part 18*a* and the adjusting nut 58.

By means of appropriately selecting the stiffness of the springs, the prestressing of the individual springs and the associated control paths, both the idling control curve and the starting range of the full-load control curve can be adapted very precisely and in many variants to the requirements of the engine.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A centrifugal rpm governor for fuel injected internal combustion engines including a housing, comprising an intermediate lever which is coupled with the supply quantity adjustment member of the injection pump which is engaged by both a control member moved by means of flyweights in accordance with rpm and a setting member which is pivotable for the purpose of arbitrary variation of the supply quantity, said governor further including a force transmitting lever which contacts a fixed stop attached to the housing, under the prestressing force of a main control spring, with which said force transmitting lever the control member comes into effective contact after covering an idling sleeve path against the force of an idling spring, further wherein said force transmitting lever is provided with an additional idling spring, further wherein the force of said additional idling spring is made partially ineffective by a thrust member that cooperates with said setting member when said setting member is pivoted by means of a service lever about a pivotal axis to advance to a full-load position, said thrust member comprising an adjustable thrust screw that is positioned securely on said setting member at a radial distance (c) from said axis of said service lever.

2. A centrifugal rpm governor in accordance with claim 1, further wherein said additional idling spring is supported by the force transmitting lever, said idling spring further including means arranged to cooperate with said control member.

3. A centrifugal rpm governor in accordance with claim 1, further wherein said additional idling spring is associated with a guide lever which is pivotable on the axis of said force transmitting lever.

4. A centrifugal rpm governor in accordance with claim 3, further wherein said additional idling spring is arranged for adjustment by means connectible to said guide.

5. A centrifugal rpm governor in accordance with claim 2, further wherein said additional idling spring is penetrated by an elongated adjustment means, said last named means having means at one end thereof arranged to cooperate with a guide lever and further means at the opposite end thereof arranged to cooperate with said setting member.

6. A centrifugal rpm governor in accordance with claim 5, further wherein said elongated adjustment means comprises a threaded element that is supported in an effective range (b) of said additional idling spring.

7. A centrifugal rpm governor in accordance with claim 2, further wherein said additional idling spring comprises a pair of leaf-type elements, one of which is connected by an elongated means to said control member and the other of said leaf-type springs arranged to cooperate with the thrust member.

8. A centrifugal rpm governor in accordance with claim 7, further wherein said leaf springs have opposite end portions and one end portion of both springs is secured to said force transmitting lever, said leaf springs further arranged to combine their force in the direction of said control member when the service lever is in the idling position in the effective range (b) of a first of said leaf springs, and the second of said leaf springs can be made ineffective even when said service lever is in the full-load position.

9. A centrifugal rpm governor in accordance with claim 8, further wherein the effective range of said first leaf spring is determined by an adjustable stop member.

10. A centrifugal rpm governor in accordance with claim 7, further wherein said leaf springs are interconnected and prestressed by a drag member.

11. A centrifugal rpm governor in accordance with claim 10, further wherein said drag member further comprises a tongue-like extension on one of said leaf springs which is arranged to extend through means defining an opening in the other of said leaf springs.

* * * * *